US011085598B2

(12) United States Patent
Ward

(10) Patent No.: US 11,085,598 B2
(45) Date of Patent: Aug. 10, 2021

(54) MODULAR LIGHTING FIXTURE

(71) Applicant: LUMI-PLUGIN LTD., Newbury (GB)

(72) Inventor: Bob Ward, Newbury (GB)

(73) Assignee: LUMI-PLUGIN LTD., Newbury (GB)

( * ) Notice: Subject to any disclaimer, the term of this patent is extended or adjusted under 35 U.S.C. 154(b) by 0 days.

(21) Appl. No.: 16/649,079

(22) PCT Filed: Sep. 7, 2018

(86) PCT No.: PCT/EP2018/074231
§ 371 (c)(1),
(2) Date: Mar. 19, 2020

(87) PCT Pub. No.: WO2019/057526
PCT Pub. Date: Mar. 28, 2019

(65) Prior Publication Data

US 2020/0271291 A1 Aug. 27, 2020

(30) Foreign Application Priority Data

Sep. 19, 2017 (GB) ..... 1715056

(51) Int. Cl.

| | |
|---|---|
| ***F21V 17/10*** | (2006.01) |
| ***F21S 8/02*** | (2006.01) |
| ***F21V 17/00*** | (2006.01) |
| ***F21V 21/04*** | (2006.01) |
| ***F21V 23/02*** | (2006.01) |
| ***F21V 25/12*** | (2006.01) |
| ***F21V 33/00*** | (2006.01) |

(Continued)

(52) U.S. Cl.
CPC ..... *F21S 8/026* (2013.01); *F21V 17/002* (2013.01); *F21V 17/105* (2013.01); *F21V 21/044* (2013.01); *F21V 23/02* (2013.01); *F21V 25/125* (2013.01); *F21V 33/0076* (2013.01); *F21Y 2103/33* (2016.08); *F21Y 2115/10* (2016.08)

(58) Field of Classification Search
None
See application file for complete search history.

(56) References Cited

U.S. PATENT DOCUMENTS

| | | | |
|---|---|---|---|
| 2010/0302758 | A1 | 12/2010 | Wang |
| 2014/0049400 | A1 | 2/2014 | Hoelzer |
| 2016/0158586 | A1 | 6/2016 | Ward |

FOREIGN PATENT DOCUMENTS

| | | | |
|---|---|---|---|
| CN | 107044601 | A | 8/2017 |
| DE | 29906760 | U1 | 9/1999 |
| JP | 2016066496 | A | 4/2016 |

OTHER PUBLICATIONS

PCT/EP2018/074231 International Search Report and Written Opinion dated Dec. 11, 2018 (21 p.).

*Primary Examiner* — Vip Patel
(74) *Attorney, Agent, or Firm* — Conley Rose, P.C.

(57) ABSTRACT

A modular lighting fixture that is capable of receiving interchangeable functional modules includes a body having a main portion and a second portion. The main portion has a hollow interior defining an interior space extending in a longitudinal direction from a first open end of the main portion to a second end of the main portion. The second portion is provided at the first end and extends outwardly in a transverse direction, wherein the interior space is configured to receive and retain a functional module configured to provide non-light emitting function. A light emitting means is provided on the second portion of the body and configured to emit light.

12 Claims, 8 Drawing Sheets

(51) Int. Cl.
*F21Y 103/33* (2016.01)
*F21Y 115/10* (2016.01)

MODULAR LIGHTING FIXTURE

CROSS-REFERENCE TO RELATED APPLICATIONS

This application is a 35 U.S.C. § 371 national stage application of PCT/EP2018/074231 filed Sep. 7, 2018, and entitled "A Modular Lighting Fixture," which claims benefit of GB patent application Serial No. 1715056.6 filed Sep. 19, 2017, and entitled "A Modular Lighting Fixture," each of which is hereby incorporated herein by reference in their entirety for all purposes.

STATEMENT REGARDING FEDERALLY SPONSORED RESEARCH OR DEVELOPMENT

Not applicable

BACKGROUND

The present disclosure relates to a modular lighting fixture. More particularly, disclosure relates to a modular lighting fixture that is capable of receiving interchangeable functional modules.

A room of any kind of building, such as a house with one or more storeys or an office building with a plurality of stories, typically has an interior space defined by the floor, the ceiling, and walls. The ceiling of a room typically includes one or more panels held in place by a support structure. The one or more panels delimit the interior space of the room and separate the room from the space between storeys or between the room and the roof of the building. Conventionally, lighting fixtures with light emitting means are coupled to electrical connections extending through the ceiling panel and attached to the room-facing side of the ceiling panel, or are provided in recesses or openings in the ceiling panel.

In addition to providing light emitting means, it is often desirable to provide other functionalities such as a sound system, a fire suppression device, or a smoke detector in the same proximity as the lighting fixture. For the above-mentioned type of lighting fixtures that are attached to the room-facing side of a ceiling panel, the lighting fixture is easily accessible such that devices and modules that provide non-light-emitting functionalities can be easily added. For the other type, it is often the case that a large portion of the light fixture is concealed and inaccessible from the room-facing side of the ceiling panel, making it difficult to add non-light-emitting devices or modules to the lighting fixture. One way to circumvent this difficulty is to have one or more additional recesses or openings in the ceiling panel, adjacent the recess/opening for the light-emitting means, for one or more non-light-emitting devices or modules. However, such an arrangement introduces complexity to the ceiling construction and increases the space required. Having a large number of devices and modules on the ceiling is also unsightly and aesthetically undesirable.

BRIEF SUMMARY OF THE DISCLOSURE

According to the first aspect of the present disclosure, there is provided a modular lighting fixture, comprising a body having a main portion and a second portion, the main portion having a hollow interior defining an interior space extending in a longitudinal direction from a first open end of the main portion to a second end of the main portion, the second portion being provided at the first end and extends outwardly in a transverse direction, wherein the interior space is configured to receive and retain a functional module configured to provide non-light emitting function; light emitting means, provided on the second portion of the body and configured to emit light; and a collar with external engagement means, the external engagement means being configured to engage corresponding engagement means on the interior of the main portion, the collar being configured to provide a seat against which the functional module rests when received in the interior space; wherein the external engagement means and the seat of the collar are arranged so as to form a gap between the body and a cover on the functional module.

In embodiments, the external engagement means and the seat of the collar are arranged so as to form a 1 mm to 5 mm gap between the body and a cover on the functional module. Preferably, the external engagement means and the seat of the collar are arranged so as to form a 3.11 mm gap between the body and a cover on the functional module.

In embodiments, the main portion has a tubular shape.

In embodiments, the modular lighting fixture further comprises one or more spring-loaded lever arms pivotally coupled to the main portion and arranged to cooperate with the second portion to function as a clamp.

In embodiments, the modular lighting fixture further comprises at least three magnetic connection points at the interior on the main portion of the body, configured to engage corresponding magnetic connection points on a functional module so as to retain the functional module in the interior space.

In embodiments, the modular lighting fixture further comprises an input power connection point, arranged on the body away from the interior space, configured to receive electrical power from an external power supply; a plurality of output connection points, arranged on the body away from the interior space; circuitry connected to the input power connection point and the plurality of output connection points; wherein the circuitry is configured to receive input power from the input power connection point, convert the received power to a corresponding number of power levels, and distribute power at the corresponding number of power levels to the plurality of output connection points. Preferably, the modular lighting fixture comprises three output connection points and the circuitry is configured to convert the received power to 3V, 5V, and 9V.

In embodiments, the modular lighting fixture further comprises a first intumescent material arranged on the exterior of the body; and a second intumescent material arranged on the interior of the body; wherein the modular lighting fixture is arranged to be received through an opening in a panel; wherein the first intumescent material is arranged on the exterior of the body such that thermal expansion of the first intumescent material seals any gap between the body and the panel; wherein the second intumescent material is arranged on the interior of the body such that thermal expansion of the second intumescent material seals any gap between the body and the functional module.

According to a second aspect of the present disclosure, there is provided a modular lighting fixture, comprising a body having a main portion and a second portion, the main portion having a hollow interior defining an interior space extending in a longitudinal direction from a first open end of the main portion to a second end of the main portion, the second portion being provided at the first end and extends outwardly in a transverse direction, wherein the interior space is configured to receive and retain a functional module configured to provide non-light emitting function; light emitting means, provided on the second portion of the body and configured to emit light; and at least three magnetic connection points at the interior on the main portion of the body, configured to engage corresponding magnetic connection points on the functional module so as to retain the functional module in the interior space.

In embodiments, the main portion has a tubular shape.

In embodiments, the modular lighting fixture further comprises one or more spring-loaded lever arms pivotally coupled to the main portion and arranged to cooperate with the second portion to function as a clamp.

In embodiments, the modular lighting fixture further comprises a cover arranged to be attached to a functional module such that when the functional module is received in the interior space, the cover conceals the functional module from sight. Preferably, the cover is arranged so as to be flush with the second portion when assembled.

In alternative embodiments, the modular lighting fixture further comprises a collar with external engagement means, the external engagement means being configured to engage corresponding engagement means on the interior of the main portion, the collar being configured to provide a seat against which the functional module rests when received in the interior space; wherein the external engagement means and the seat of the collar are arranged so as to form a gap between the body and a cover on the functional module. Preferably, the external engagement means and the seat of the collar are arranged so as to form a 1 mm to 5 mm gap between the body and a cover on the functional module. More preferably, the external engagement means and the seat of the collar are arranged so as to form a 3.11 mm gap between the body and a cover on the functional module.

In embodiments, the modular lighting fixture further comprises an input power connection point, arranged on the body away from the interior space, configured to receive electrical power from an external power supply; a plurality of output connection points, arranged on the body away from the interior space; circuitry connected to the input power connection point and the plurality of output connection points; wherein the circuitry is configured to receive input power from the input power connection point, convert the received power to a corresponding number of power levels, and distribute power at the corresponding number of power levels to the plurality of output connection points. Preferably, the modular lighting fixture comprise three output connection points and the circuitry is configured to convert the received power to 3V, 5V, and 9V.

In embodiments, the modular lighting fixture further comprises a first intumescent material arranged on the exterior of the body; and a second intumescent material arranged on the interior of the body; wherein the modular lighting fixture is arranged to be received through an opening in a panel; wherein the first intumescent material is arranged on the exterior of the body such that thermal expansion of the first intumescent material seals any gap between the body and the panel; wherein the second intumescent material is arranged on the interior of the body such that thermal expansion of the second intumescent material seals any gap between the body and the functional module.

According to a third aspect of the present disclosure, there is provided a modular lighting fixture, comprising a body having a main portion and a second portion, the main portion having a hollow interior defining an interior space extending in a longitudinal direction from a first open end of the main portion to a second end of the main portion, the second portion being provided at the first end and extends outwardly in a transverse direction, wherein the interior space is configured to receive and retain a functional module configured to provide non-light emitting function; light emitting means, provided on the second portion of the body and configured to emit light; an input power connection point, arranged on the body away from the interior space, configured to receive electrical power from an external power supply; a plurality of output connection points, arranged on the body away from the interior space; circuitry connected to the input power connection point and the plurality of output connection points; wherein the circuitry is configured to receive input power from the input power connection point, convert the received power to a corresponding number of power levels, and distribute power at the corresponding number of power levels to the plurality of output connection points.

In embodiments, the modular lighting fixture comprise three output connection points and the circuitry is configured to convert the received power to 3V, 5V, and 9V.

In embodiments, the main portion has a tubular shape.

In embodiments, the modular lighting fixture further comprises one or more spring-loaded lever arms pivotally coupled to the main portion and arranged to cooperate with the second portion to function as a clamp.

In embodiments, the modular lighting fixture further comprises a cover arranged to be attached to a functional module such that when the functional module is received in the interior space, the cover conceals the functional module from sight. Preferably, the cover is arranged so as to be flush with the second portion when assembled.

In alternative embodiments, the modular lighting fixture further comprises a collar with external engagement means, the external engagement means being configured to engage corresponding engagement means on the interior of the main portion, the collar being configured to provide a seat against which the functional module rests when received in the interior space; wherein the external engagement means and the seat of the collar are arranged so as to form a gap between the body and a cover on the functional module. Preferably, the external engagement means and the seat of the collar are arranged so as to form a 1 mm to 5 mm gap between the body and a cover on the functional module. More preferably, the external engagement means and the seat of the collar are arranged so as to form a 3.11 mm gap between the body and a cover on the functional module.

In embodiments, the modular lighting fixture further comprises at least three magnetic connection points at the interior on the main portion of the body, configured to engage corresponding magnetic connection points on a functional module so as to retain the functional module in the interior space.

In embodiments, the modular lighting fixture further comprises a first intumescent material arranged on the exterior of the body; and a second intumescent material arranged on the interior of the body; wherein the modular lighting fixture is arranged to be received through an opening in a panel; wherein the first intumescent material is arranged on the exterior of the body such that thermal expansion of the first intumescent material seals any gap between the body and the panel; wherein the second intumescent material is arranged on the interior of the body such that thermal expansion of the second intumescent material seals any gap between the body and the functional module.

According to a fourth aspect of the present disclosure, there is provided a modular lighting fixture, comprising a body having a main portion and a second portion, the main portion having a hollow interior defining an interior space extending in a longitudinal direction from a first open end of the main portion to a second end of the main portion, the second portion being provided at the first end and extends outwardly in a transverse direction, wherein the interior space is configured to receive and retain a functional module configured to provide non-light emitting function; light emitting means, provided on the second portion of the body and configured to emit light; a first intumescent material arranged on the exterior of the body; and a second intumescent material arranged on the interior of the body; wherein the modular lighting fixture is arranged to be received through an opening in a panel; wherein the first intumescent material is arranged on the exterior of the body such that thermal expansion of the first intumescent material seals any gap between the body and the panel; wherein the second intumescent material is arranged on the interior of the body such that thermal expansion of the second intumescent material seals any gap between the body and the functional module.

In embodiments, the main portion has a tubular shape.

In embodiments, the modular lighting fixture further comprises one or more spring-loaded lever arms pivotally coupled to the main portion and arranged to cooperate with the second portion to function as a clamp.

In embodiments, the modular lighting fixture further comprises a cover arranged to be attached to a functional module such that when the functional module is received in the interior space, the cover conceals the functional module from sight. Preferably, the cover is arranged so as to be flush with the second portion when assembled.

In alternative embodiments, the modular lighting fixture further comprises a collar with external engagement means, the external engagement means being configured to engage corresponding engagement means on the interior of the main portion, the collar being configured to provide a seat against which the functional module rests when received in the interior space; wherein the external engagement means and seat of the collar are arranged so as to form a gap between the body and a cover on the functional module. Preferably, the external engagement means and the seat of the collar are arranged so as to form a 1 mm to 5 mm gap between the body and a cover on the functional module. More preferably, the external engagement means and seat of the collar are arranged so as to form a 3.11 mm gap between the body and a cover on the functional module.

In embodiments, the modular lighting fixture further comprises at least three magnetic connection points at the interior on the main portion of the body, configured to engage corresponding magnetic connection points on a functional module so as to retain the functional module in the interior space.

In embodiments, the modular lighting fixture further comprises an input power connection point, arranged on the body away from the interior space, configured to receive electrical power from an external power supply; a plurality of output connection points, arranged on the body away from the interior space; circuitry connected to the input power connection point and the plurality of output connection points; wherein the circuitry is configured to receive input power from the input power connection point, convert the received power to a corresponding number of power levels, and distribute power at the corresponding number of power levels to the plurality of output connection points. Preferably, the modular lighting fixture comprise three output connection points and the circuitry is configured to convert the received power to 3V, 5V, and 9V.

BRIEF DESCRIPTION OF THE DRAWINGS

Exemplary embodiments of the present disclosure will hereinafter be described, with references to the accompanying drawings, in which.

DETAILED DESCRIPTION OF THE DISCLOSED EXEMPLARY EMBODIMENTS

Figure 1:
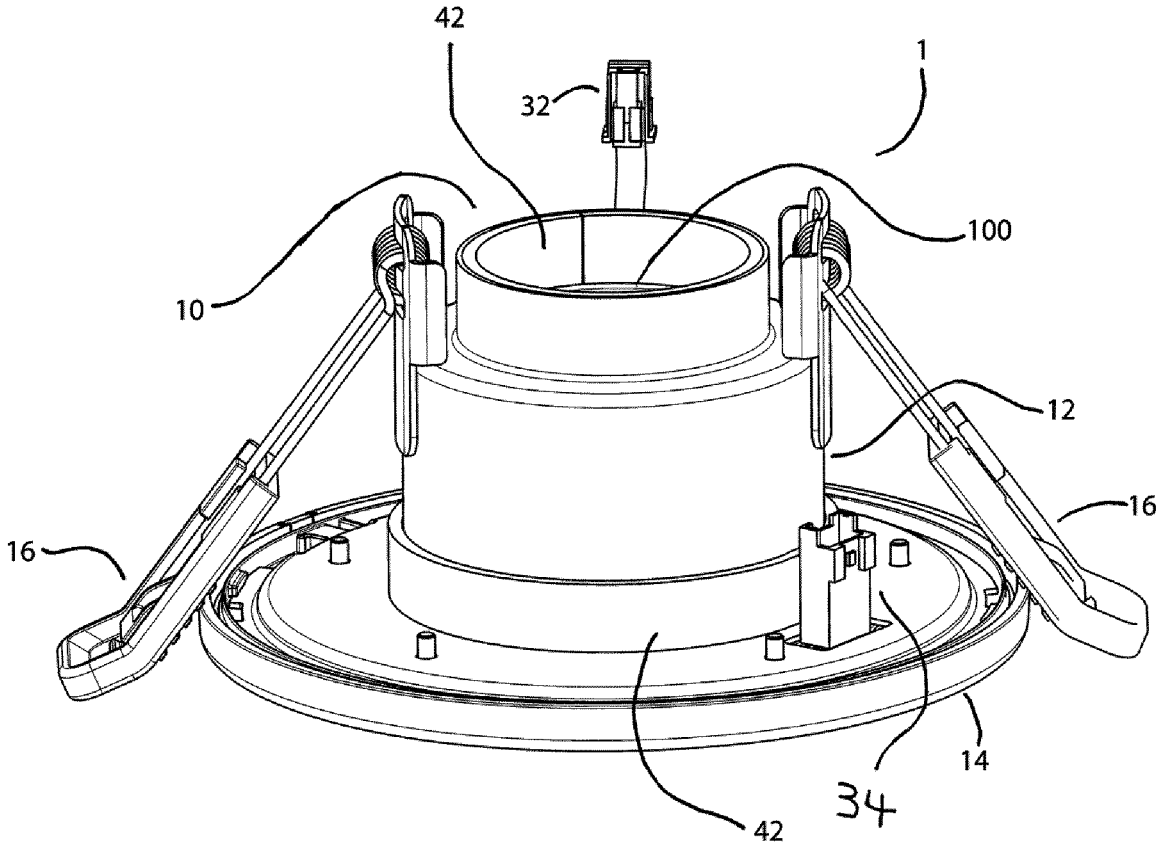
FIG. 1 is an upper perspective view of a modular lighting fixture.

Referring to FIG. 1, there is shown a modular lighting fixture 1 configured to be received or mounted in a recess or opening in the ceiling panel. In embodiments, the modular lighting fixture 1 comprises a body 10 that has a generally tubular main portion 12 and a second portion 14 provided circumferentially at one end of the main portion 12. The second portion 14 extends radially outwards from the main portion 12. In some embodiments, the main portion 12 is a cylindrical tube and the second portion 14 has a similar arrangement to a flange so as to give the body 10 a top hat shaped silhouette. Embodiments of the modular lighting fixture 1 are generally configured to be received in a recess or opening that is sized for the dimensions of the main portion 12 of the body 10. For example, in the embodiments in which the main portion 12 is a cylindrical tube, the entrance of the recess or the opening would have a diameter that allows close passage of the body 10 therethrough. In embodiments in which the main portion 12 is another shape, the entrance of the recess or the opening in the ceiling panel would be sized and shaped corresponding to allow close passage of the body 10 therethrough. The second portion 14 is generally of larger dimensions than the entrance of the recess or the opening and would sit against the room-facing side of the ceiling panel.

Referring still to FIG. 1, the modular lighting fixture 1 is mounted to the ceiling panel by way of any suitable means. In some embodiments, one or more spring-loaded lever arms 16 are provided on the exterior of the main portion 12 of the body 10. The spring-loaded lever arms 16 are arranged to extend radially outward and are pivoted at the main portion 12 of the body 10. The spring-loaded lever arms 16 are also biased so as to co-operate with the second portion 14 of the body 10 to function as a clamp to engage respective sides of the ceiling panel. In other embodiments, the modular lighting fixture 1 is mounted to the ceiling panel by screw or bolts through the second portion 14 of the body 10. In some embodiments, two lever arms 16 are provided on diametrically opposite locations on the body 10 of the modular lighting fixture 1. In some other embodiments, three or four lever arms 16 are provided.

Figure 2:
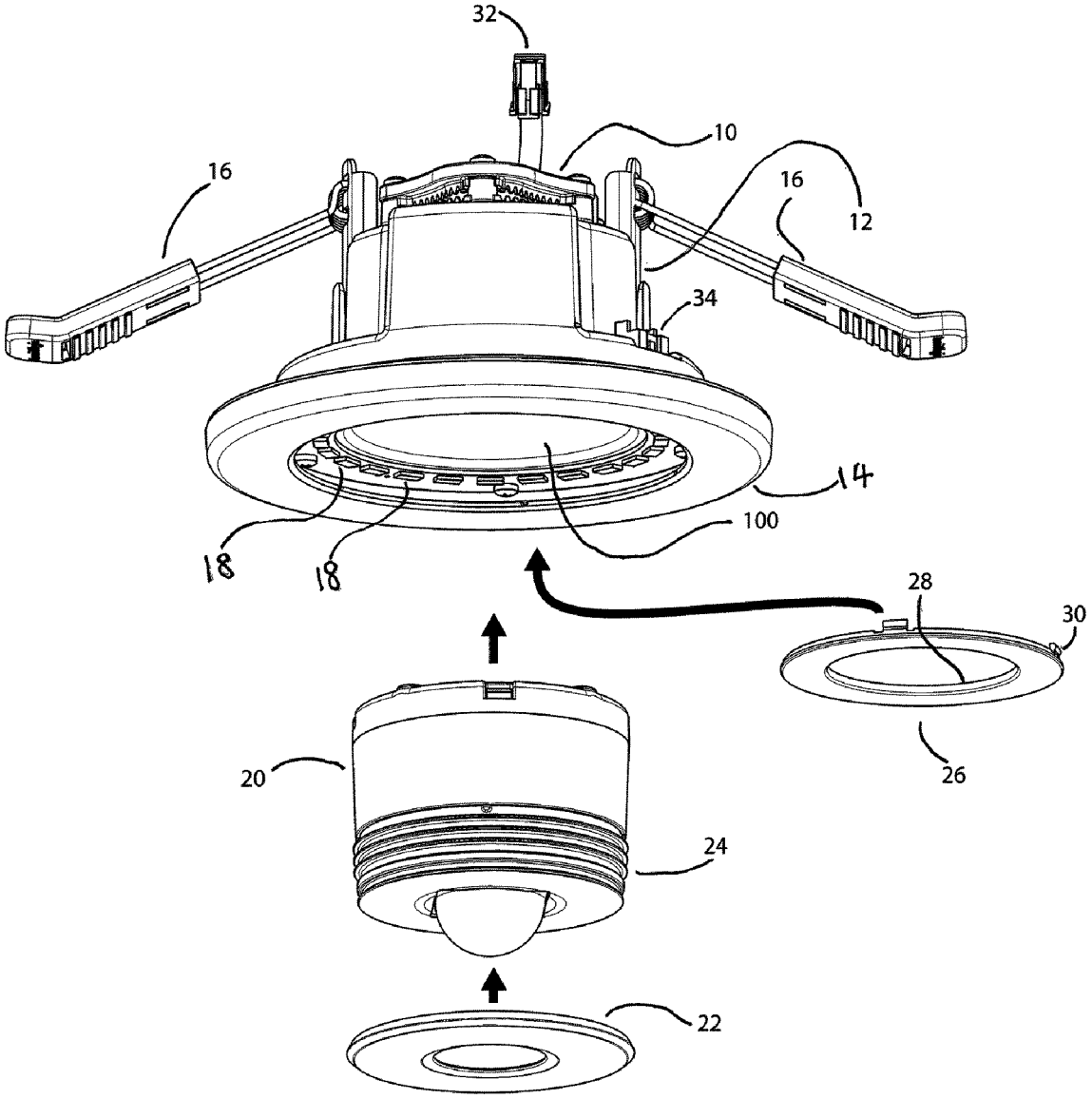
FIG. 2 is a lower perspective view of a modular lighting fixture together with a loose functional module, a loose cover, and a loose collar.

In embodiments, as shown in FIG. 2, light emitting means 18 are provided on the second portion 14, generally arranged in a configuration that allows light emitted from the light emitting means 18 to reach the room in which the modular lighting fixture 1 is installed. In some of these embodiments, the light emitting means 18 includes one or more light emitting diodes (LEDs). The light emitting means 18 are arranged on the second portion 14 of the body 10 in any suitable arrangement. In some embodiments, the light emitting means 18 are arranged to be equidistant apart. In embodiments in which the second portion 14 of the body 10 is ring-shaped, the light emitting means 18 are arranged along a circular locus on the second portion 14. The second portion optionally includes a complimentarily shaped cap (not shown in FIG. 2), such as an annular shape, provided to fit over the light emitting means 18. In some embodiments, the cap has corresponding apertures to allow light from the light emitting means 18 to pass through. Each aperture optionally includes a lens for focusing the light emitted from the light emitting means 18. In another arrangement, a ring shape slit is provided in the cap and a diffuser or lens is provided in the slit. In some other embodiments, the cap made be made entirely of a translucent material and is fitted over the light emitting means 18 to function as a light diffuser.

Referring to FIG. 2, the end of the main portion 12 at which the second portion 14 is arranged provides an opening into the interior space 100 defined by the main portion 12. In more particular terms, in embodiments in which the main portion 12 is tubular, the open end of the end at which the second portion 14 is arranged provides the aforementioned opening. In some embodiments, the other end of the main portion 12 is also an open end. In some other embodiments, the other end is at least partially closed by an end piece (not shown). The interior space 100 defined by the main portion 12 of the body 10 has a generally central axis and is configured to receive and retain an interchangeable functional module 20. A functional module is a detachable module that is capable of non-light-emitting functions. For example, in some embodiments, a functional module 20 may be a speaker, a smoke or fire alarm, a fire sprinkler, a combination of a smoke or fire alarm with a fire sprinkler, or any other suitable device. In some embodiments, an optional cover 22 is provided and arranged on the functional module 20 such that the cover 22 conceals the functional module 20 from sight when the functional module 20 is received in the interior space 100 of the body 10. For example, the cover 22 of some of these embodiments is arranged on the functional module 20 so as to be flush with the second portion 14 of the body 10. The interior surface of the main portion 12 and the exterior surfaces of the functional module 20 are provided with cooperating engagement means 24 so as to enable the body 10 of the modular lighting fixture 1 to retain the functional module 20 in the interior space 100 of the body 10 when the modular lighting fixture 1 is in use. In some embodiments, the engagement means 24 may be a simple snap lock mechanism, or a bayonet mount mechanism, or a screw mount mechanism. In some embodiments, the engagement means 24 are in the form of magnets. In these embodiments, one or more magnetic connection points are provided at the interior of the main portion 12 of the body 10 for engagement with corresponding magnetic connection points on the exterior of the functional module 20. In some of these embodiments, the magnetic connection points on the body 10 are formed from permanent magnets and the corresponding magnetic connection points on the functional module 20 are either permanent magnets or paramagnets. In some other embodiments, the magnetic connection points on the body 10 are either permanent magnets or paramagnets and corresponding magnetic connection points on the functional module 20 are formed from permanent magnets. In some embodiments, two magnetic connection points are provided on the body 10. In some other embodiments, three or more magnetic connection points are provided on the body 10. The arrangement with three or more magnetic connection points is advantageous in that it allows the functional module 20 to be retained in the body 10 more securely whilst still allowing easy changing from one functional module 20 to another.

Figure 3:
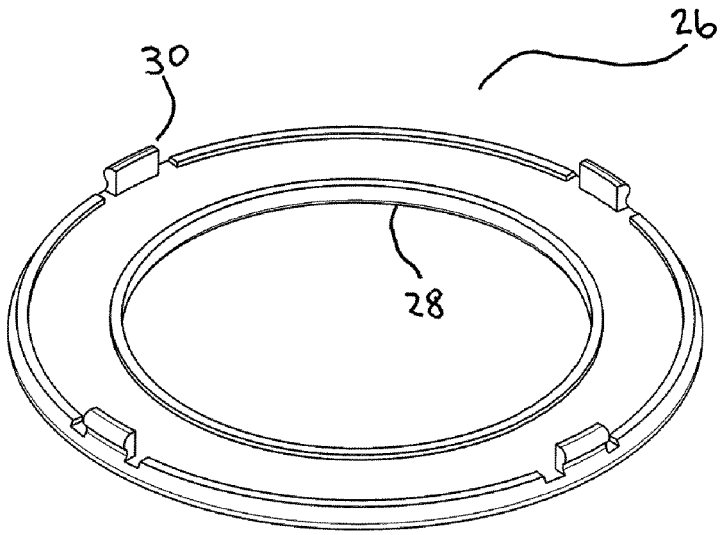
FIG. 3 is a perspective view of a collar for a modular lighting fixture.

Generally, the exterior of a functional module 20 is arranged to fit the interior of the body 10 of the modular lighting fixture 1. However, in some embodiments, the exterior of the functional is not arranged to fit the interior of the body 10. For example, in embodiments, the functional module 20 may be smaller than the interior space 100 of the body 10. In these embodiments, a collar 26 is provided to enable the smaller functional module 20 to be received and retained in the interior space 100 of the modular lighting fixture 1. The collar 26, shown in more detail in FIG. 3, has an exterior portion and an internal portion and is generally configured to be positioned around the exterior of the smaller functional module 20. In some embodiments, the exterior portion of the collar 26 has external engagement means 30 configured to engage the body 10 of the modular lighting fixture 1. The external engagement means 30 may be configured in any suitable way, so as to engage the brim of the main portion 12 proximal to the second portion 14 for example, or to engage the second portion 14 proximal the brim of the main portion 12. In embodiments, the collar 26 is configured to provide a seat against which the smaller functional module 20 rests when it is received and retained in the interior space 100 of the modular lighting fixture 1. In embodiments, the internal portion of the collar 26 optionally includes complimentarily configured internal engagement means 28 corresponding to the engagement means 24 on the exterior of the smaller functional module 20 for engagement therewith. In other word, in these embodiments, with a collar 26 engaged on the exterior, the smaller functional module 20 may be received and retained in the same manner as functional modules 20 that are arranged to fit the interior of the body 10 of the modular lighting fixture 1. In embodiments in which the smaller functional module 20 includes a portion having a circular cross section and in which the main portion 12 of the body 10 is tubular, the collar 26 is ring-shaped and is configured to be mounted to the circumference of the aforementioned portion of the smaller functional module 20.

At least one input power connection point 32 is provided on the modular lighting fixture 1 to enable the modular lighting fixture 1 to be electrically connected to an external power supply. The input power connection point 32 is connected to circuitry (not shown) provided on the modular lighting fixture 1, which is configured to take power received from the input power connection point 32 and deliver appropriate power to the light emitting means 18. The circuitry is also configured to take the power received from the input power connection point 32 and to distribute power to one or more output connection points 34 provided on the modular lighting fixture 1 for supplying power to the functional module 20 that is installed in the body 10 of the modular lighting fixture 1. In various embodiments, different functional modules 20 have different power requirements. In these embodiments, the circuitry is configured to convert the input power received from the input power connection point 32 to different levels and to deliver the different levels of power to corresponding number of output connection points 34. In some embodiments, the modular lighting fixture 1 is configured to receive three different types of functional modules 20, each requiring a different level of power. In these embodiments, three output connection points 34 are provided. In particular embodiments, the modular lighting fixture 1 is configured to receive functional modules 20 that require 3V, 5V, and 9V respectively. In these embodiments, the circuitry is configured to deliver the three different levels of power to three different output connection points 34. The input power connection point 32 may be provided on any suitable location on the modular lighting fixture 1. In embodiments, the input power connection point 32 is provided on the exterior of the main portion 12 body 10. The output connection points 34 are generally provided away from the interior of the body 10 to leave the maximum amount of space for the functional module 20. In embodiments, the output connection points 34 are provided on the exterior of the main portion 12 of the body 10. In embodiments, the functional module 20 is arranged to couple to an output connection point 34 by way of an electrical lead. By providing separate connection points for different power levels, a different functional module 20 requiring a different voltage can be simply connected to a different output connection point 34 with no further configuration required.

In particular embodiments, the functional module 20 is a smaller functional module 20 or a non-specific functional modules 20 that is not specifically designed to be installed into the modular lighting fixture 1. For example, a typical known drop-down fire sprinkler is design to be fitted directly in a space provided in the ceiling or overhead panel. A cover 22 is provided on the smaller functional module 20 or the non-specific functional modules 20 and is arranged so that the smaller functional module 20 or the non-specific functional modules 20 is obscured from sight when it is installed into the body 10 of the modular lighting fixture 1. The collar 26 of these particular embodiments is arranged so that a gap is provided between the cover 22 and the body 10 when the smaller functional module 20 or the non-specific functional modules 20 is received in the body 10. In some of these embodiments, the collar 26 is arranged so as to provide a gap between 1 mm and 5 mm wide. In more particular embodiments, the collar 26 is arranged so as to provide a gap between 2 mm and 4 mm wide. In particular embodiments, the collar 26 is arranged so as to provide a 3.11 mm wide gap. This arrangement allows the cover 22 to conceal the smaller functional module 20 or the non-specific functional modules 20 from sight, which is aesthetically more pleasing to the eye. In the case in which the non-specific functional module 20 is a known drop-down fire sprinkler, providing a gap allows for any smoke or hot air caused by fire to reach the fire sprinkler to allow the fire sprinkler to operate normally. In embodiments, the collar 26 is generally ring-shaped so as to fit around a portion of a smaller functional module 20 that has a circular exterior. In the case in which the non-specific functional module 20 is a known drop-down fire sprinkler, the collar 26 is configured to provide a seat against which the drop-down fire sprinkler rests which it is received in the interior space 100 of the main portion 12. The drop-down fire sprinkler is held in place by any suitable means known to the skilled person, for example by coupling to plumbing fixtures that are also configured to supply the drop-down fire sprinkler with water. The exterior of drop-down fire sprinkler may optionally have attachment mechanisms 40 and the interior portion of the collar 26 optionally includes internal engagement means 38 that are configure in a suitable way apparent to the skilled person to be capable of engaging the exterior of the drop-down fire sprinkler.

In some of the above-described embodiments, the modular lighting fixture 1 further includes intumescent material 42 provided at various locations on the modular lighting fixture 1. An intumescent material is one that expands upon application of heat and its provision on the modular lighting fixture 1 is particularly preferable for embodiments in which the functional module 20 (or smaller functional module 20 or non-specific functional module 20) received in the modular lighting fixture 1 relates to fire safety. Referring back to FIG. 1, the intumescent material 42 is preferably provided at locations where the exterior of the modular lighting fixture 1 meets another object or article, such as the opening in the ceiling or ceiling panel. It is more generally preferable to provide the intumescent material 42 at locations that would otherwise provide a gap or passageway through which fire is able to spread. For example, intumescent material 42 is additionally or alternatively provided at the interior of the body 10 to fill any gaps between the body 10 and the functional module 20 (or smaller functional module 20 or non-specific functional module 20) when it is received in the body 10. By providing an intumescent material 42 to close off gaps, the modular lighting fixture 1 is able to provide the open-ended interior space 100 in the body 10 to allow easy and simple changing of the functional module 20 whilst maintaining its fire prevention ratings by closing off gaps through which fire could spread.

Referring to FIGS. 4 to 8, a particular embodiment of the modular lighting fixture 1 is configured to be received and installed through an opening 1002 in a ceiling panel 1000. In this particular embodiment, the modular lighting fixture 1 includes a body 50 having a generally tubular main portion 52 defining an interior space 54. The main portion 52 has two open ends, hereinafter referred to as the first open end 56 and the second open end 58, and the interior space 54 extends in a generally longitudinal direction from the first open end 56 to the second open end 58. The main portion 52 has a number of sections, each with a different transverse cross section. A second portion 60 of the body 50 has a platform that extends outwardly around the brim at the first open end 56 of the main portion 52. The body 50 further includes an exterior enclosure 62 that surrounds at least a section of the main portion 52 of the body 50. In this particular embodiment, the enclosure 62 is positioned near the first end 56 and abuts the platform of the second portion 60 when the modular lighting fixture 1 is assembled. The section of the enclosure 62 adjacent the platform has a transverse cross section sized to provide a close fit through the opening 1002 in the ceiling panel 1000. The longitudinal thickness of this section is determined in accordance with the thickness of the ceiling panel 1000. The second portion 60 of the body 50 has outer dimensions that are larger than the opening 1002 in the ceiling so as to prevent the modular lighting fixture 1 from being passed all the way through the opening 1002. To install, the modular lighting fixture 1 is inserted into the opening 1002 in the ceiling panel 1000 from the second end 58 until the second portion 60 of the body 50 abuts the room-facing side of the ceiling panel 1000.

Light emitting diodes 64 (LEDs) are connected to control circuitry 66, all mounted on the room-facing side of the platform of the second portion 60. The LEDs 64 are spaced apart across the room-facing surface of the platform. The second portion 60 further includes a complimentarily shaped cap 68, configure to fit over the room-facing side of the platform. In one arrangement, the cap 68 has an annular shape and is formed from a translucent material so that when it is fitted over the LEDs, it functions as a light diffuser. In another arrangement, a corresponding number of apertures are provided on the cap 68 for each LED 64 mounted on the platform. In this arrangement, the apertures allow the LEDs 64 to be exposed when the cap 68 is fitted over the platform whilst concealing the circuitry 66 from sight. Optionally, diffusers or lenses may be fitted in the apertures. The control circuitry 66 is also connected to an input power connection point 70 provided at a location on the body 50 that is concealed from sight by the ceiling panel 1000 when the modular lighting fixture 1 is installed. The input power connection point 70 is configured to be connected to an external power supply.

Two spring-loaded lever arms 72 are provided on diametrically opposite locations on the exterior of the main portion 52 of the body 50. The arms 72 are each pivotally connected to the main portion 52 and are each spring-loaded at the pivot 74. The arms 72 extend away from the body 50 in a generally transverse direction and are each configured for pivotal movement in a plane normal to the transverse axis. The spring of each arm 72 is configured to bias the arm 72 towards the second portion 60 of the body 50. To install the modular lighting fixture 1, the arms 72 are lifted against the bias away from the second portion 60 for insertion through the opening 1002 in the ceiling panel 1000. Once the modular lighting fixture 1 is in place, i.e. with the platform of the second portion 60 of the body 50 abutting the room-facing side of the ceiling panel 1000, the arms 72 are released. Once released, the arms 72 and the platform co-operate to clamp the modular lighting fixture 1 to the ceiling panel 1000.

Figure 4:
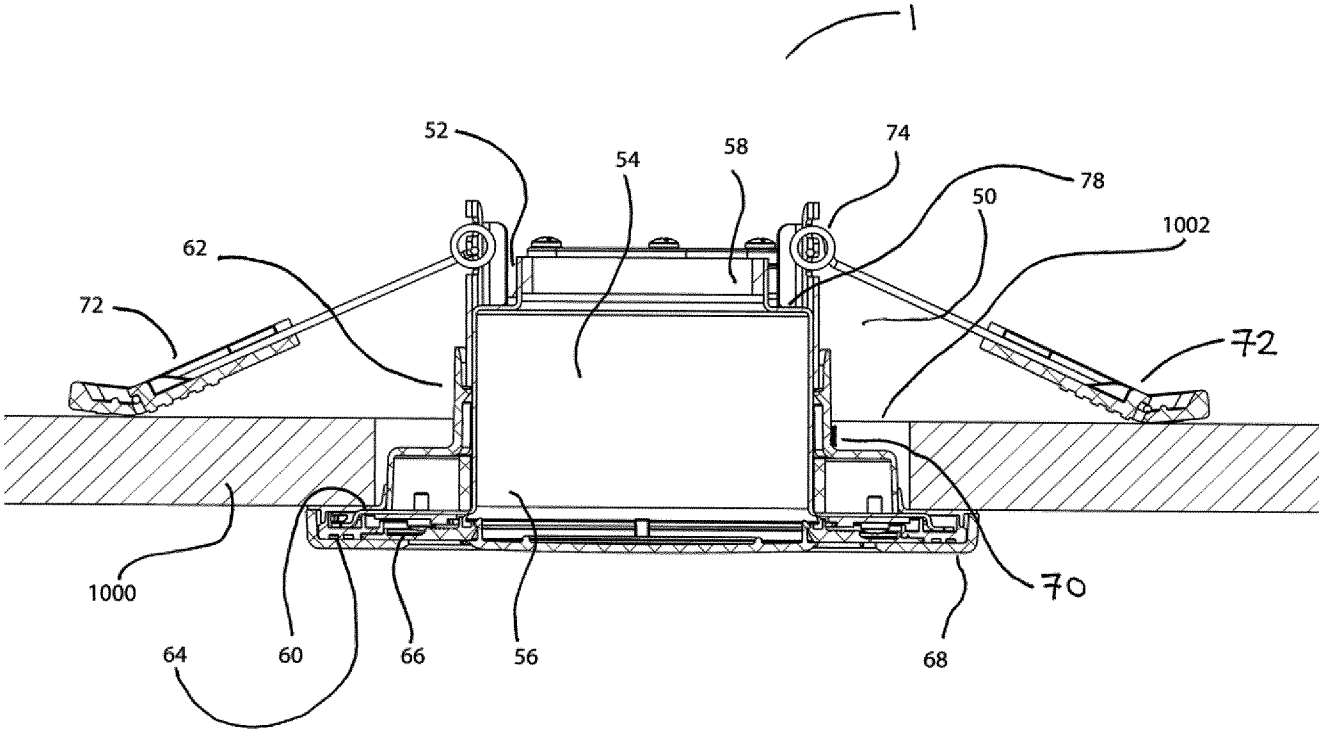
FIG. 4 is a longitudinal cross section view of another modular lighting fixture.
Figure 5:
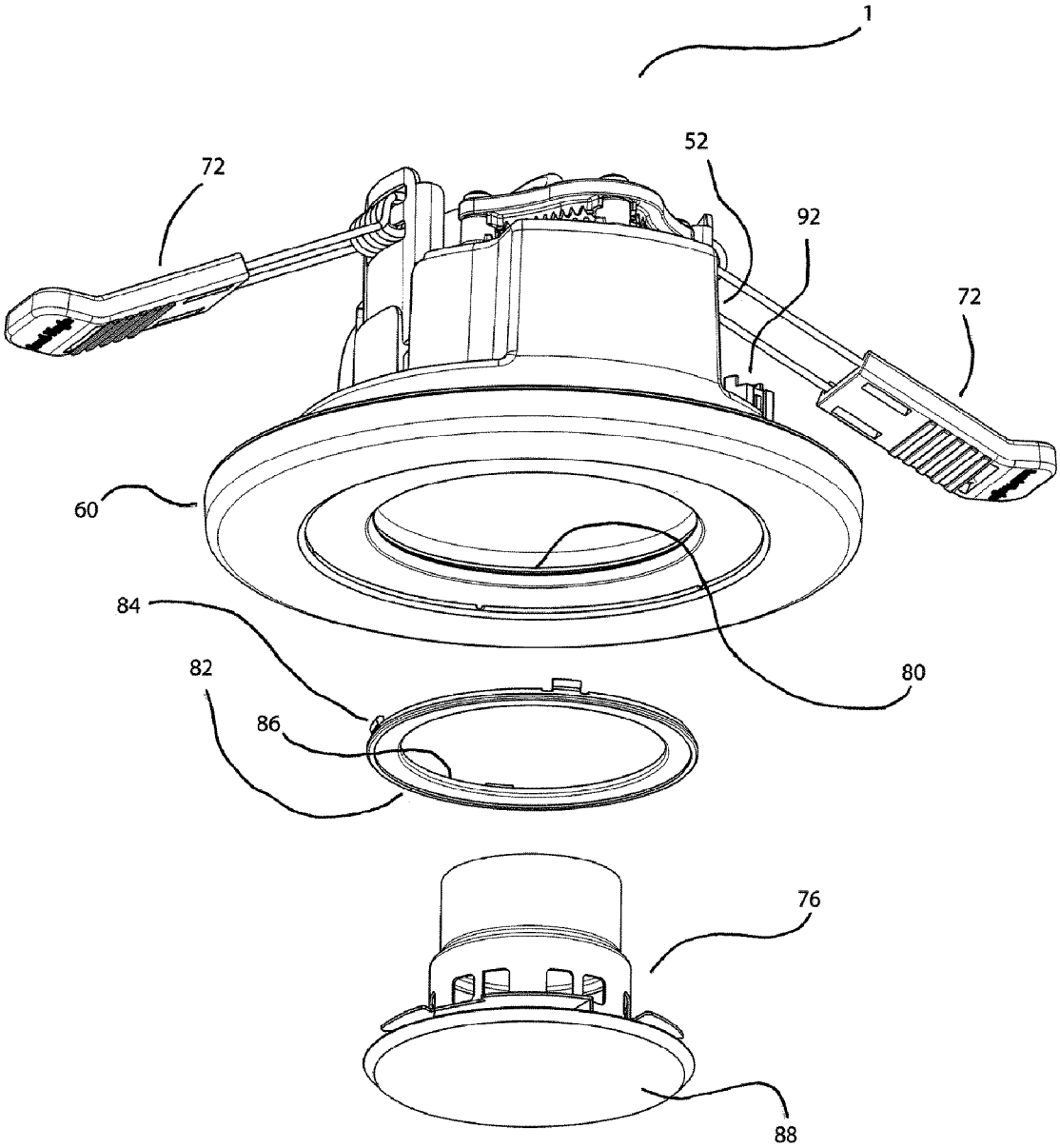
FIG. 5 is a lower perspective view of the modular lighting fixture of FIG. 4 together with a loose functional module, a loose cover, and a loose collar.

As shown in FIG. 5, the interior space 54 defined by the main portion 52 of the body 50 is configured to receive and retain a functional module 76. The second end 58 of the main portion 52 of the body 50 has a narrower cross section and is joined to the rest of the main portion 52 by a shoulder 78 as shown in FIG. 4. Three magnetic connection points (not shown) are provided on the interior-facing side of the shoulder 78 for engaging corresponding magnetic connection points on a functional module 76. The first end 56 of the main portion 52 of the body 50 is left open to allow a functional module 76 to be inserted into the interior space 54. Once inserted, the magnetic connection points engage the corresponding magnetic connection points on a functional module 76 and the functional module 76 is retained.

Figure 6:
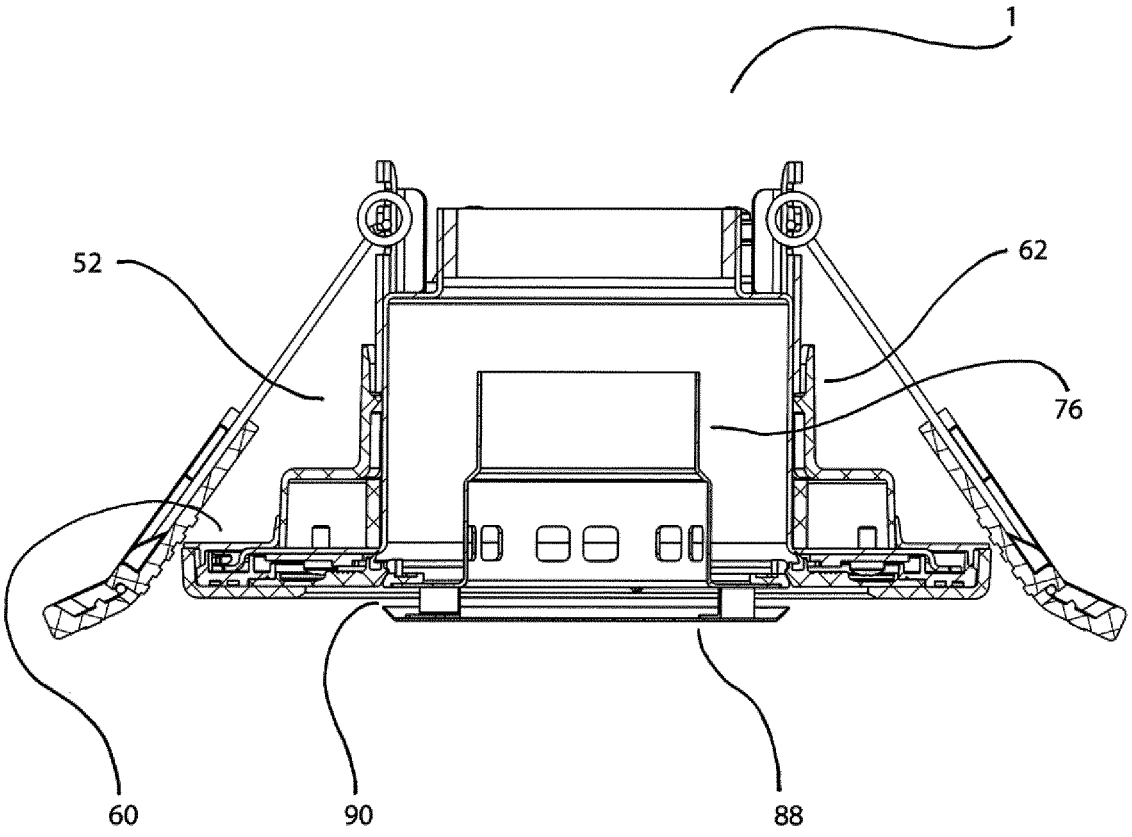
FIG. 6 is a longitudinal cross section view FIG. 5, assembled to illustrate the gap between the cover and the functional module.

In one arrangement, the interior side near the first end 56 of the main portion 52 of the body 50 has engagement means 80 in the form of one part of a bayonet mount configured to engage a collar 82 with corresponding exterior engagement means 84 on the exterior in the form of the counter part of the bayonet mount on the body 50 of the modular lighting fixture 1. In another arrangement, engagement means 80 are provided on the second portion 60 of the body 50, proximal to the first end 56 of the main portion 52. In some arrangements, the collar 82 is configured to provide a seat against which a known drop-down fire sprinkler rests when it is received and retained in the interior space 54 defined by the main portion 52 of the body 50. In these arrangements, the drop-down fire sprinkler is secured in the interior space 54 by any suitable means known to the skilled person, for example by coupling to plumbing fixtures that are configured to supply water to the drop-down fire sprinkler. In some of these arrangements, the interior of the collar 82 also has engagement means 86 adapted to engage the drop-down fire sprinkler so as to retain the drop-down fire sprinkler in the interior space 54 defined by the main portion 52 of the body 50. As shown in FIG. 6, the drop-down fire sprinkler typically has a cover 88 attached thereto to conceal it from sight when it is not deployed. The engagement means of the exterior of the collar 82, and engagement means of the interior of the collar 82 in arrangements that has engagement means at the interior of the collar 82, are arranged to be off set in the longitudinal direction such that the cover and the body 50 are separated by a 3.11 mm wide gap 90 when the drop-down fire sprinkler is resting against the seat of the collar 82. The open second end 58 of the main portion 52 of the body 50 allows the drop-down fire sprinkler to be connected to an external water supply.

The modular lighting fixture 1 of this particular embodiment is further configured to operate with different functional modules 76 that require different levels of electrical power. For this purpose, output connection points 92 are provided on the exterior of the main portion 52 of the body 50. The output connection points 92 are connected to the circuitry 66, which is configured to take electrical power received from an external power supply and to step-down the received power to various different levels for delivery to corresponding output connection points 92. In this particular embodiment, the circuitry 66 is configured to step-down the received electrical power to 3V, 5V, and 9V, and to deliver the different voltages to three corresponding output connection points 92. The output connection points 92 are configured for connection with whatever function module 76 that is received in the interior space 54 of the body 50 via electrical cables. The open second end 58 of the main portion 52 of the body 50 allows an electrical cable to connect the functional module 76 to an output connection point.

Figure 7:
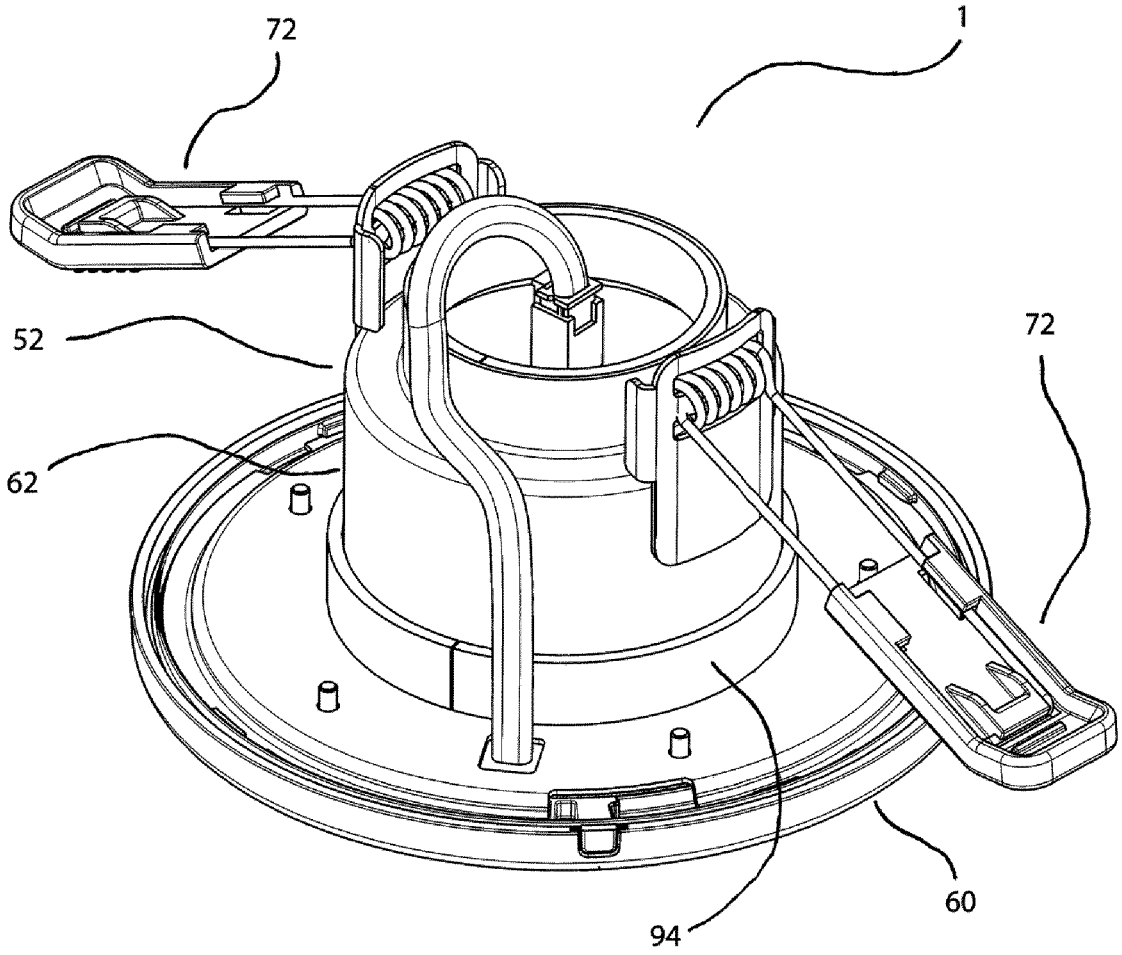
FIG. 7 is an upper perspective view of the modular lighting fixture of FIG. 4 together with an intumescent material on one part of the modular lighting fixture.
Figure 8:
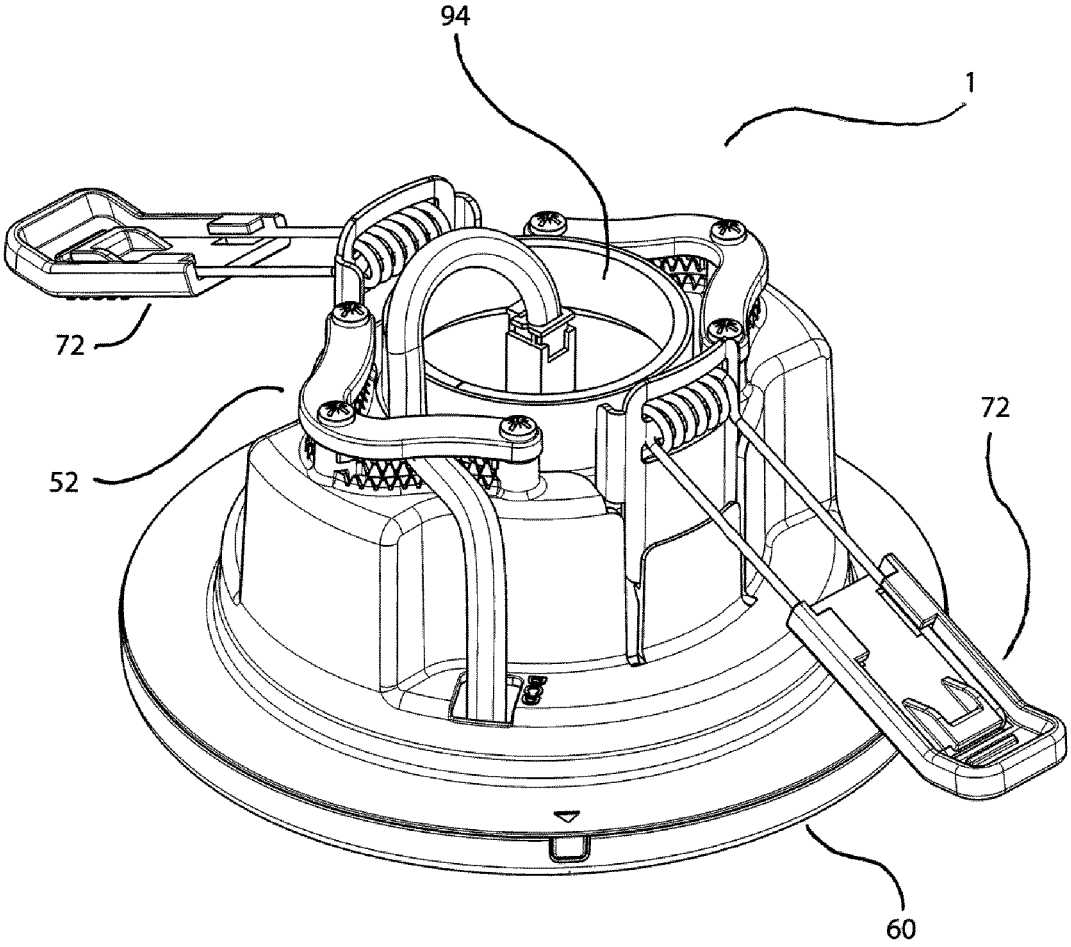
FIG. 8 is an upper perspective view of the modular lighting fixture of FIG. 4 together with an intumescent material on another part of the modular lighting fixture.

As shown in FIG. 7, an intumescent material 94 is provided around the transverse exterior of the enclosure 62 where the modular lighting fixture 1 would meet the ceiling panel 1000 when it is installed. Providing the intumescent material 94 in this area ensures that if a fire occurs in the area below the ceiling, the intumescent material 94 would expand due to the heat, closing off any gap between the ceiling panel 1000 and the modular lighting fixture 1, and prevent the fire from spreading through the ceiling panel 1000. For the same purpose, shown in FIG. 8, intumescent material 94 is also provided on the interior of the main portion 52 of the body 50 near the second end 58 where the body 50 would meet the functional module 76 when one is installed. Providing intumescent material 94 in this area ensures that if a fire occurs in the area below the ceiling, the intumescent material 94 would expand due to the heat, closing off any gap between the body 50 of the modular lighting fixture 1 and the functional module 76, and prevent the fire from spreading through the modular lighting fixture 1.

Although the exemplary embodiments described hereinabove as being configured to be received or mounted in a recess or opening that is in the ceiling, it will be appreciated that the recess or opening may be provided in any suitable place, such as in a wall or in the floor. It will also be appreciated that instead of a tubular shape, the main portion of the body of the modular lighting fixture may be of any other suitable shape. For example, the main portion may be a tube with a non-circular or irregular cross section and may be straight or bent.

Exemplary embodiments of the present invention have been described above, and with particular reference to the drawings provided. However, it will be appreciated that variations and modifications may be made to those examples and that the invention is not limited to or defined by those examples, the invention instead being defined by the claims that are set out below.

The invention claimed is:

1. A modular lighting fixture, comprising:

a body having a main portion and a second portion, the main portion having a hollow interior defining an interior space extending in a longitudinal direction from a first open end of the main portion to a second end of the main portion, the second portion being provided at the first end and extends outwardly in a transverse direction, wherein the interior space is configured to receive and retain a functional module configured to provide non-light emitting function;

light emitting means, provided on the second portion of the body and configured to emit light; and a collar with external engagement means configured to engage corresponding engagement means on the interior of the main portion, wherein the collar is configured to provide a seat against which the functional module rests when received in the interior space;

wherein the external engagement means of the collar and the seat are arranged so as to form a gap between the body and a cover on the functional module.

2. A modular lighting fixture as claimed in claim 1, further comprising at least three magnetic connection points at the interior on the main portion of the body, configured to engage corresponding magnetic connection points on a functional module so as to retain the functional module in the interior space.

3. A modular lighting fixture as claimed in claim 1, further comprising:

an input power connection point, arranged on the body away from the interior space, configured to receive electrical power from an external power supply;

a plurality of output connection points, arranged on the body away from the interior space;

circuitry connected to the input power connection point and the plurality of output connection points;

wherein the circuitry is configured to receive input power from the input power connection point, convert the received power to a corresponding number of power levels, and distribute power at the corresponding number of power levels to the plurality of output connection points.

4. A modular lighting fixture as claimed in claim 3, wherein the modular lighting fixture comprise three output connection points and the circuitry is configured to convert the received power to 3V, 5V, and 9V.

5. A modular lighting fixture as claimed in claim 1, further comprising:

a first intumescent material arranged on the exterior of the body; and a second intumescent material arranged on the interior of the body;

wherein the modular lighting fixture is arranged to be received through an opening in a panel;

wherein the first intumescent material is arranged on the exterior of the body such that thermal expansion of the first intumescent material seals any gap between the body and the panel;

wherein the second intumescent material is arranged on the interior of the body such that thermal expansion of the second intumescent material seals any gap between the body and the functional module.

6. A modular lighting fixture as claimed in claim 5, further comprising a collar with external engagement means, the external engagement means being configured to engage corresponding engagement means on the interior of the main portion, the collar being configured to provide a seat against which the functional module rests when received in the interior space; wherein the external engagement means and the seat of the collar are arranged so as to form a gap between the body and a cover on the functional module.

7. A modular lighting fixture as claimed in claim 5, further comprising at least three magnetic connection points at the interior on the main portion of the body, configured to engage corresponding magnetic connection points on a functional module so as to retain the functional module in the interior space.

8. A modular lighting fixture as claimed in claim 5, further comprising:

a first intumescent material arranged on the exterior of the body; and a second intumescent material arranged on the interior of the body;

wherein the modular lighting fixture is arranged to be received through an opening in a panel;

wherein the first intumescent material is arranged on the exterior of the body such that thermal expansion of the first intumescent material seals any gap between the body and the panel;

wherein the second intumescent material is arranged on the interior of the body such that thermal expansion of the second intumescent material seals any gap between the body and the functional module.

9. A modular lighting fixture as claimed in claim 1, wherein the external engagement means and the seat of the collar are arranged so as to form a 1 mm to 5 mm gap between the body and a cover on the functional module.

10. A modular lighting fixture as claimed in claim 1, wherein the external engagement means and the seat of the collar are arranged so as to form a 3.11 mm gap between the body and a cover on the functional module.

11. A modular lighting fixture as claimed in claim 1, wherein the main portion has a tubular shape.

12. A modular lighting fixture as claimed in claim 1, further comprising one or more spring-loaded lever arms pivotally coupled to the main portion and arranged to cooperate with the second portion to function as a clamp.

* * * * *